US005277367A

United States Patent [19]

Hsu

[11] Patent Number: 5,277,367

[45] Date of Patent: Jan. 11, 1994

[54] SPRAY GUN PRESSURIZED AIR CONTROL SYSTEM

[76] Inventor: Ching-Ho Hsu, No. 9-1, Lane 271, Sec. 3, Roosevelt Rd., Taipei, Taiwan

[21] Appl. No.: 909,736

[22] Filed: Jul. 7, 1992

[51] Int. Cl.[5] ..... B05B 1/28

[52] U.S. Cl. ..... 239/73; 239/74; 239/300; 239/414

[58] Field of Search ..... 239/71, 73, 74, 290, 239/300, 301, 353, 414, 415, 530, DIG. 14

[56] References Cited

U.S. PATENT DOCUMENTS

| | | | |
|---|---|---|---|
| 1,677,446 | 7/1928 | Hartmetz | 239/583 |
| 1,779,922 | 10/1930 | Thompson | 239/300 |
| 1,982,055 | 11/1934 | Jenkins | 239/301 |
| 2,060,894 | 11/1936 | Potter | 239/301 |
| 2,795,460 | 6/1957 | Bletcher et al. | 239/530 |
| 4,817,872 | 4/1989 | Mattson | 239/300 |
| 5,152,460 | 10/1992 | Barty | 239/300 |

*Primary Examiner*—Karen B. Merritt

*Attorney, Agent, or Firm*—Morton J. Rosenberg; David I. Klein

[57] ABSTRACT

A spray gun pressurized air control system includes an air adjusting knob, a trigger, a trigger seat within a housing, and a control ring. The air adjusting knob comprises a knob at one end having indicia marked thereon, and a hollow shank at the other end to receive a spring therein. An inner end of the spring engages with one end of an enlarged portion of a pin. The other end of the enlarged portion engages with the bottom portion of an L-shaped plate extending downward from one end of the trigger. By adjusting the knob to a predetermined position, pressurized air may be released from a valve controlled by the trigger.

1 Claim, 5 Drawing Sheets

SPRAY GUN PRESSURIZED AIR CONTROL SYSTEM

BACKGROUND OF THE INVENTION

1. Field of the Invention

This invention relates to spray guns. More particularly, this invention pertains to a spray gun which includes indicia adapted to adjust pressurized air output volume so as to achieve a high quality painting.

2. Prior Art

Many people are increasingly doing their own minor repairs in their homes due to high labor rates of professional service people. In many instances, painting is one endeavor that people prefer to do themselves. However, prior art spray guns as shown in FIG. 5 are generally composed of a housing 10 having a paint reservoir detachably mounted to the bottom portion of the housing 10 with a linking block 40 shaped in the form of a reversed letter U which has one end pivotally secured to the trigger 30 at a cavity area 50. The other end of the linking block 40 has a pin 60 extending therethrough. One end of the pin 60 is secured to an adjusting knob 70. This prior art spray gun has a number of disadvantages. The trigger 30 of such prior art spray guns may be actuated by children and cause physical injury. In other instances when the job is interrupted, it is difficult to adjust output volume of pressurized air. A further disadvantage is that children may be accidentally pinched by the linking block 40 or the pin 60. It is therefore an object of this invention to overcome the disadvantages previously described.

SUMMARY OF THE INVENTION

It is the primary object of the present invention to provide a spray gun pressurized air control system which includes a scale to measure and control pressurized air output.

It is another object of the present invention to provide a spray gun pressurized air control system which increases the quality of painting.

It is still another object of the present invention to provide a spray gun pressurized air control system which optimizes safety when operating.

It is a further object of the present invention to provide a spray gun pressurized air control system which is easy to operate.

DETAILED DESCRIPTION OF THE PREFERRED EMBODIMENT

Figure 1:
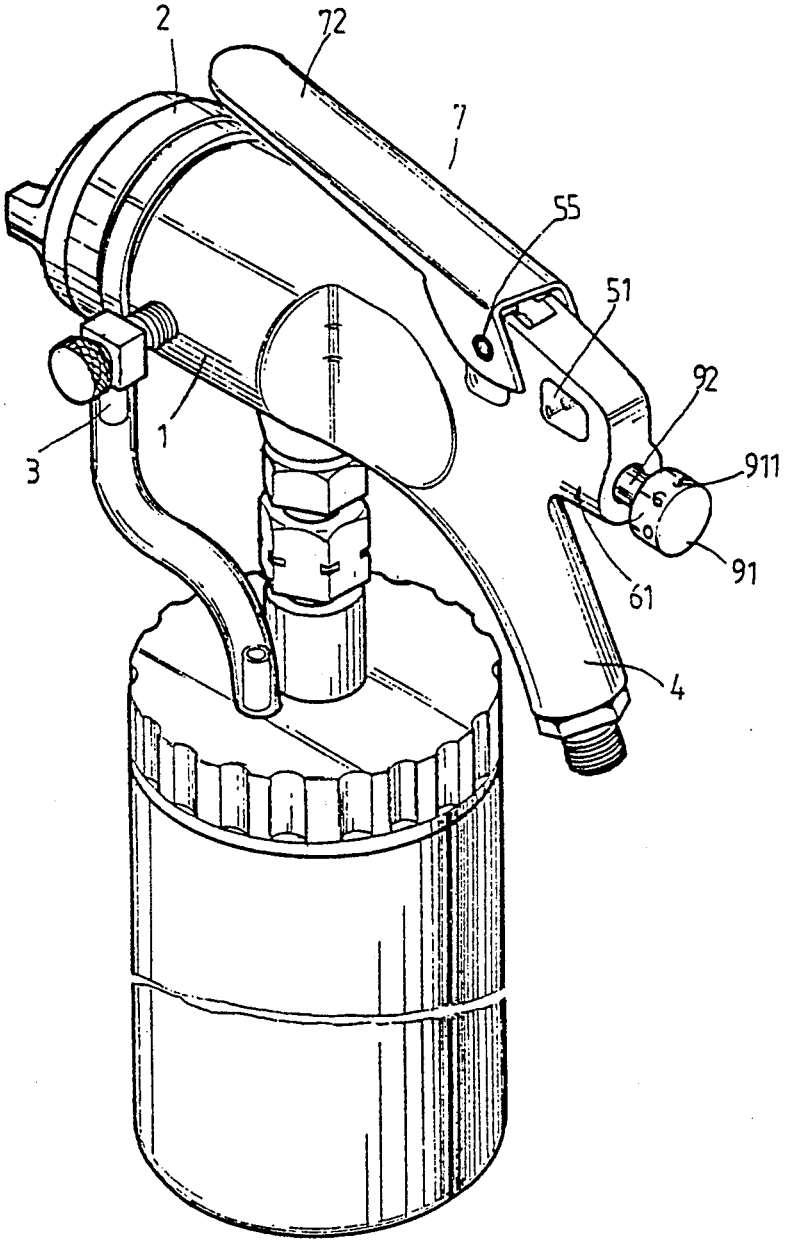
FIG. 1 is a perspective view of the present invention system.
Figures 2A, 2B:
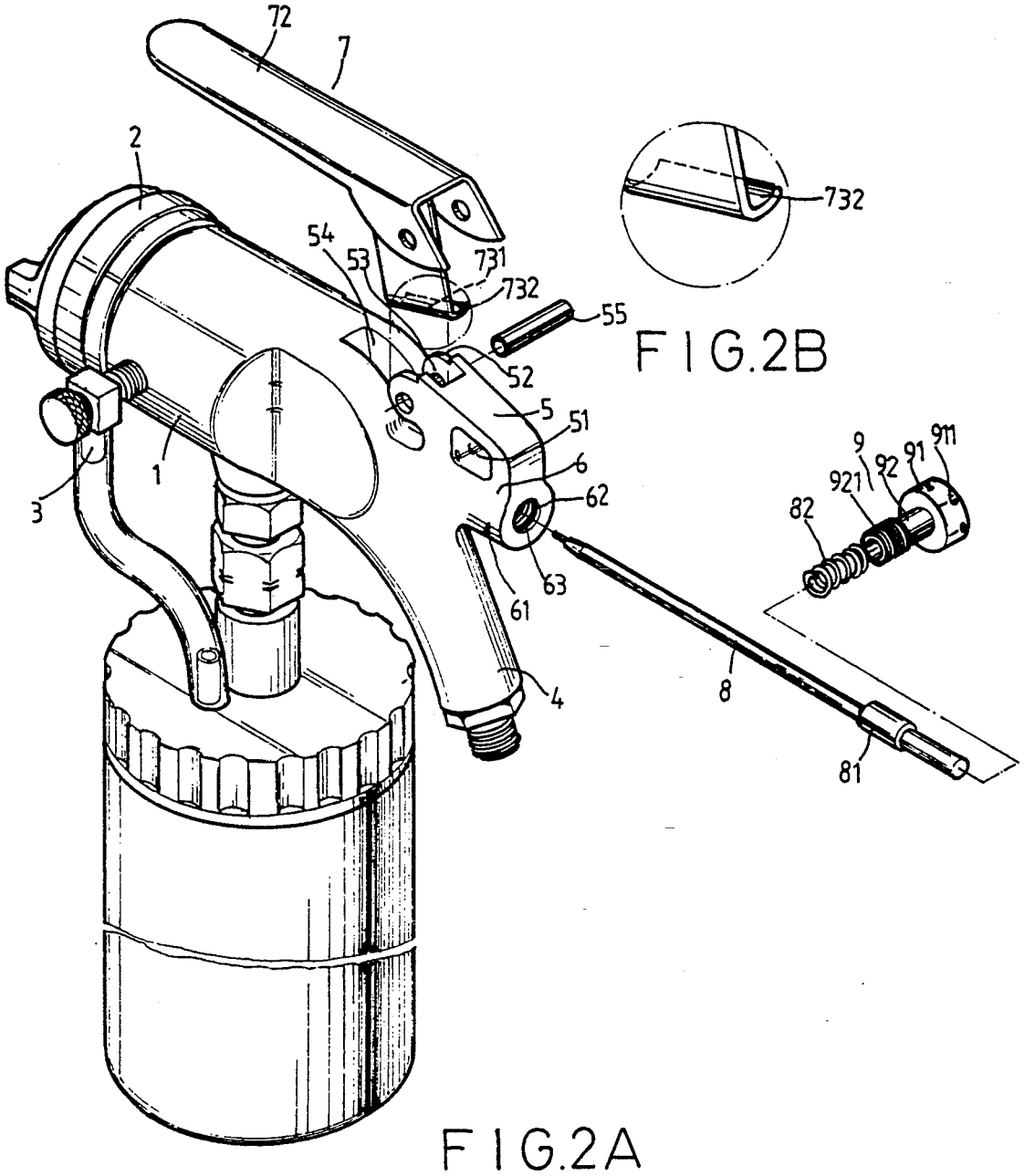
FIG. 2A is a fragmentary view of the system shown in FIG. 1.
FIG. 2B is an enlarged view of an L-shaped plate of a trigger provided in FIG. 2A.

Referring now to the drawings, FIGS. 1–4 are presented for the purpose of illustrating a preferred embodiment and not for the purpose of limiting the same. FIGS. 1, 2A, and 2B show the present invention composed essentially of a housing 1, a controlling ring 2, a pipe 3, a handle 4 having a valve stem 41, first indicia 911, a trigger 7, a pin 8, and an adjusting knob 9 upon which first indicia 911 is formed.

Figure 3B:
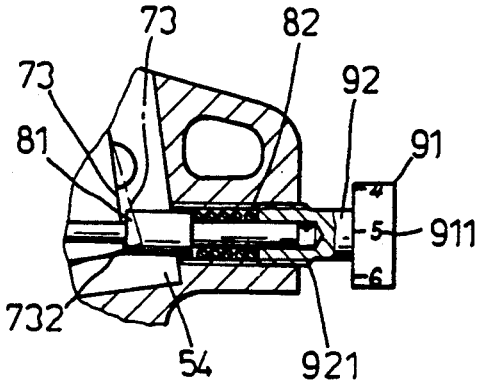
FIG. 3B is an enlarged cross-sectional view of the rear portion of the housing of the spray gun showing the adjusting knob.
Figure 3A:
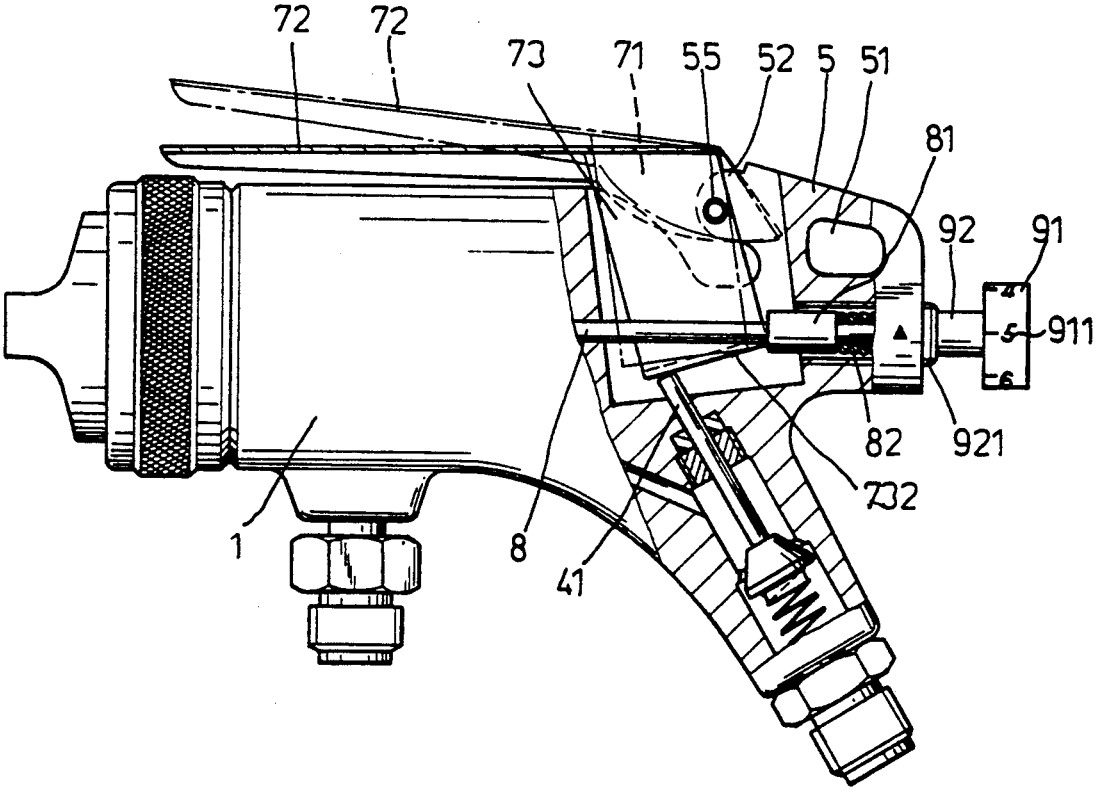
FIG. 3A is a side elevational view of FIG. 1, partially sectioned, having a scale indicia for alignment with a control indicia which allows air output with a predetermined volume.

The housing 1 has a seat 5 forming a rear portion which is adapted to receive the trigger 7. The housing 1 has a finger grip 51 for insertion of a person's forefinger and an identical pair of spaced apart lugs 52. A trough 53 is formed between the lugs 52, and a recess chamber 54 is formed therein extending toward the front end of housing 1. Each lug 52 has an aperture in alignment to each other adapted to secure the trigger 7 thereto by means of a pin 55. The trigger 7 has an engagement end 71 and an extending end 72. An L-shaped plate 732, as shown in FIGS. 3A and 3B extends downwardly from the engagement end 71 and is adapted to receive the pin 8 for seating thereon, and to further engage and contact the valve stem 41 with the bottom portion of the plate 732.

Housing 1 includes a pin hole 62 formed along its axis adapted to receive the pin 8, and an internal threaded portion 63 for threaded connection with the adjusting knob 9. Second indicia 61 is formed on the housing 1 as is shown in FIG. 3A.

Figure 4:
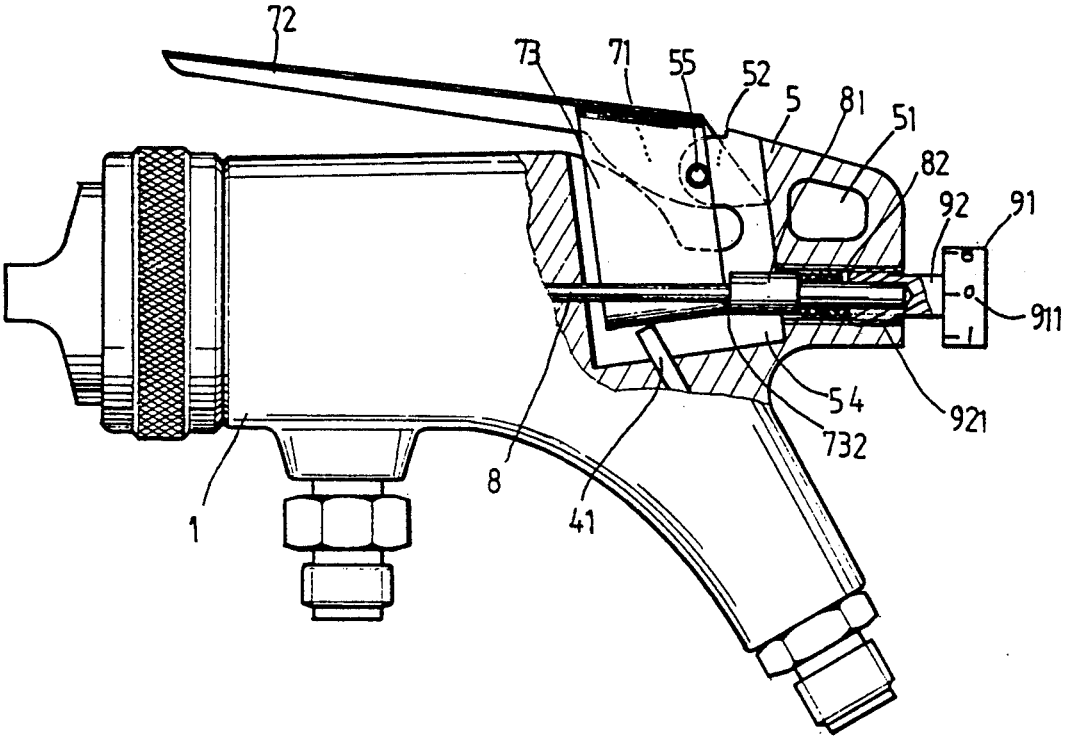
FIG. 4 is a side elevational view of FIG. 1, partially sectioned, showing the scale indicia set at "0" which locks the trigger in order that no air is allowed to be output; and, FIG. 5 is an elevational view, partially cut-away of a prior art spray gun.
Figure 5:
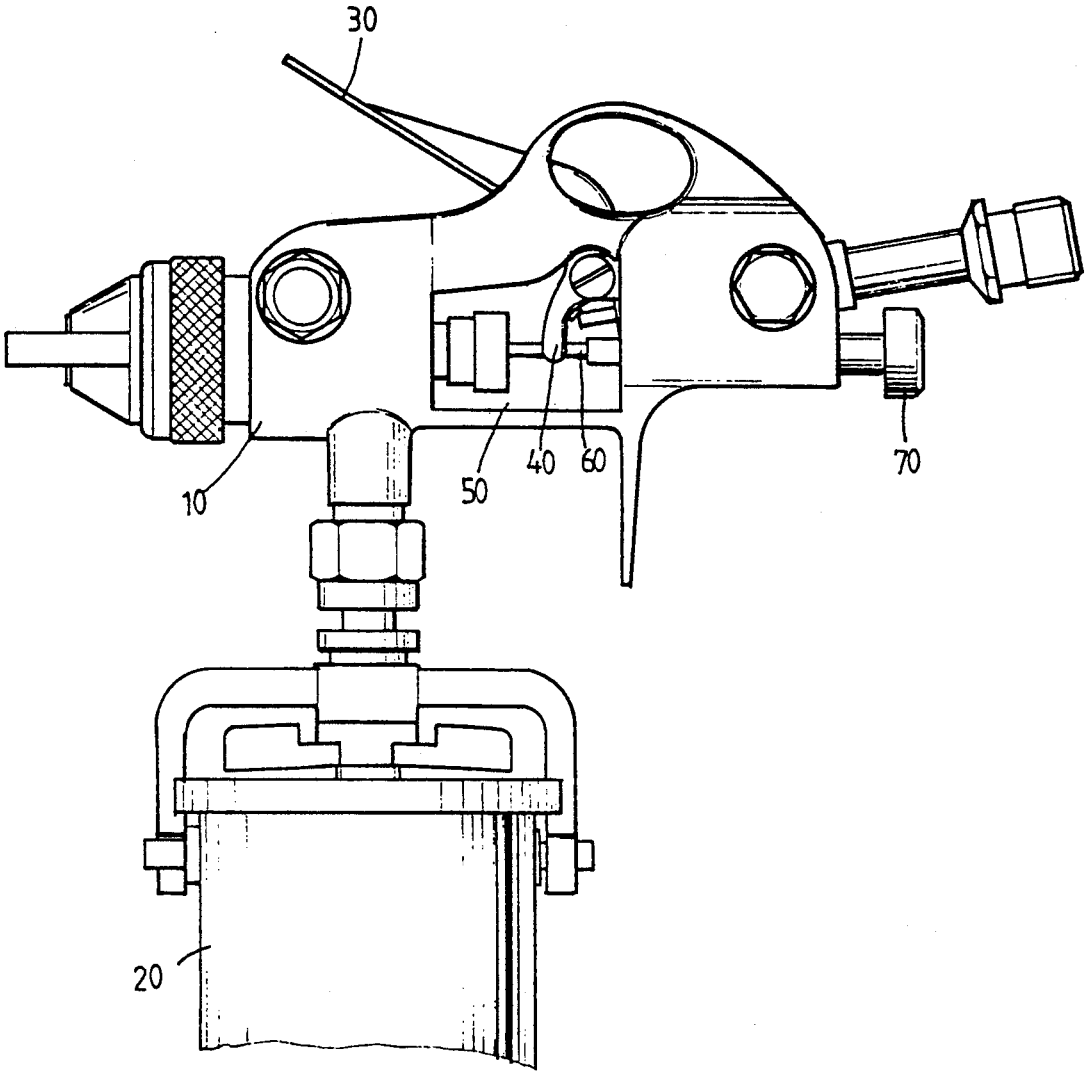
PRIOR ART FIG.5

Pin 8 has a longitudinal body with an enlarged portion 81. One end of enlarged portion 81 engages with the rear end of the bottom portion of the L-shaped plate 732, as shown in FIG. 4, so that when trigger 7 is displaced, pin 8 is simultaneously urged backward. The other end of the enlarged portion 81 is in contiguous contact with a spring 82.

Adjusting knob 9 includes a knob 91 and a hollow shank 92 formed thereon and adapted to receive the spring 82 to seat therein having a threaded portion 921 for threaded connection with the pin hole 62.

The knob 91 has first indicia 911 formed on it in order to acquire a correct output volume of pressurized air.

In operation, the knob 91 is initially turned to align a first indicia 911 with second indicia 61. The rotation of the knob 91 moves the adjusting knob 9 and spring 82 simultaneously either forwardly or backwardly, as shown in FIG. 4. The more the shank 92 is threaded inwardly, the tighter or more force biased spring 82 will be and the lesser amount of space remains for the pin 8 to be pulled rearwardly when the trigger 7 is pressed. The valve stem 41 is also displaced downwardly by the L-shaped plate 732 and thus pressurized air enters housing 1. Opposingly, the more the shank 92 as well as the spring 82 is threaded or displaced outwardly, the more the pin 8 can be pulled rearwardly, and the more air passes through the displacement of valve stem 41 into housing 1.

I claim:

1. A spray gun pressurized air control system having an air input valve including a stem wherein the improvement comprises:

(a) a gun housing having a seat portion formed on one end thereof for receipt of a displaceable trigger, said seat portion having a finger grip and a pair of spaced apart leg members defining a trough therebetween;

(b) an L-shaped plate member defining a substantially vertically directed leg member and a substantially horizontally directed leg member, said vertically directed leg member fixedly coupled to a rear section of said trigger and said horizontally directed leg member for contacting and displacing said air input valve stem for controlling air passage amounts into said gun housing;

(c) a cylindrical pin having an enlarged portion defining opposing enlarged pin portion ends, one of said ends for contacting said horizontally directed leg member of said L-shaped plate member, said other of said ends bearing against a spring member mounted in said gun housing; and, (d) an adjustment knob having first indicia formed thereon having a hollow shank extending therefrom and threadedly secured to said gun housing, said hollow shank for receipt of one end of said cylindrical pin and in contiguous contact with said spring member, said adjustment knob first indicia for alignment with second indicia formed on a sidewall of said gun housing, whereby alignment of predetermined first indicia with said second indicia defines a predetermined displacement of said air input valve stem for controlling pressurized air input to said gun housing.

* * * * *